US007490989B2

(12) United States Patent
Kobetsky et al.

(10) Patent No.: US 7,490,989 B2
(45) Date of Patent: Feb. 17, 2009

(54) SLIDER FOR OPERATING ZIPPER OF EVACUABLE STORAGE BAG

(75) Inventors: Robert G. Kobetsky, Chicago, IL (US); Gerald W. Sweeney, Incline Village, NV (US)

(73) Assignee: Illinois Tool Works Inc., Glenview, IL (US)

( * ) Notice: Subject to any disclaimer, the term of this patent is extended or adjusted under 35 U.S.C. 154(b) by 707 days.

(21) Appl. No.: 10/940,213

(22) Filed: Sep. 13, 2004

(65) Prior Publication Data

US 2006/0056743 A1 Mar. 16, 2006

(51) Int. Cl.
*B65D 33/16* (2006.01)
*A44B 1/04* (2006.01)

(52) U.S. Cl. ..... 383/64; 24/399; 24/430

(58) Field of Classification Search ..... 383/64; 24/399, 400, 430

See application file for complete search history.

(56) References Cited

U.S. PATENT DOCUMENTS

| | | | | | |
|---|---|---|---|---|---|
| 1,959,318 | A * | 5/1934 | Sundback | ..... | 24/400 |
| 3,259,951 | A * | 7/1966 | Zimmerman | ..... | 24/399 |
| 5,283,932 | A * | 2/1994 | Richardson et al. | ..... | 24/400 |
| 5,480,030 | A | 1/1996 | Sweeney et al. | | |
| 5,996,187 | A * | 12/1999 | Tanaka et al. | ..... | 24/399 |
| 6,178,602 | B1 | 1/2001 | Burke et al. | | |
| 6,450,686 | B1 * | 9/2002 | May | ..... | 383/64 |
| 6,568,046 | B1 | 5/2003 | Savicki et al. | | |
| 6,846,107 | B2 * | 1/2005 | Sweeney et al. | ..... | 383/64 |
| 6,854,887 | B2 * | 2/2005 | Anderson | ..... | 383/64 |
| 7,188,394 | B2 * | 3/2007 | Turvey et al. | ..... | 24/415 |
| 7,251,864 | B2 * | 8/2007 | Chang | ..... | 24/30.5 R |
| 7,305,742 | B2 * | 12/2007 | Anderson | ..... | 24/400 |
| 2004/0014579 | A1 * | 1/2004 | Sweeney et al. | ..... | 493/394 |
| 2004/0037478 | A1 * | 2/2004 | Anderson | ..... | 383/64 |
| 2005/0025396 | A1 | 2/2005 | ErkenBrack | | |
| 2005/0196077 | A1 * | 9/2005 | Ootsubo et al. | ..... | 383/64 |

FOREIGN PATENT DOCUMENTS

| | | | |
|---|---|---|---|
| WO | WO 00/76343 | A1 | 12/2000 |
| WO | WO 00/76354 | A1 | 12/2000 |

* cited by examiner

*Primary Examiner*—Jes F Pascua
(74) *Attorney, Agent, or Firm*—Ostrager Chong Flaherty & Broitman P.C.

(57) ABSTRACT

Sliders for closing the zipper of an evacuable storage bag. The slider is generally U-shaped and comprises a pair of mutually opposing sidewalls, a bridge connecting the sidewalls, and a generally U-shaped stiffening rib projecting outward from the sidewalls and bridge. In accordance with various aspects of the invention: (1) portions of the sidewalls on both sides of the stiffening rib have undulating external surfaces that facilitate manufacture by injection molding; (2) both sides of the stiffening rib are provided with respective curved depressions that are generally symmetrical relative to a central plane of the slide and that facilitate grasping by the storage bag user; and (3) retaining hooks at the distal ends of the sidewalls have angled surfaces that form an included angle of 30 to 45 degrees at an entry point into the gap between the sidewalls to facilitate automated slider insertion onto a zipper.

15 Claims, 4 Drawing Sheets

SLIDER FOR OPERATING ZIPPER OF EVACUABLE STORAGE BAG

BACKGROUND OF THE INVENTION

This invention generally relates to reclosable bags having slider-operated zippers. In particular, the invention relates to evacuable reclosable storage containers having a slider that closes but does not open the zipper.

Collapsible, evacuable storage containers typically include a flexible, airtight bag, an opening through which an article is inserted inside the bag, a zipper for closing the opening and hermetically sealing the bag, and a fixture through which excess air is evacuated from the bag. A user places an article into the bag through the opening, seals the opening, and then evacuates the air in the bag through the fixture. With the bag thus evacuated, a compressible article contained therein may be significantly compressed so that it is easier to transport and requires substantially less storage space.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

Not only large, compressible items such as clothing may be stored in a collapsible, evacuable storage container. For example, it may be desirable to store bulk items made of small particles, such as powders or granulated resins, in an evacuated container. One situation that commonly occurs is that a particular bulk item is shipped in a large, rigid container such as a drum. Bulk items may be moisture sensitive and are sealed against moisture during shipment. But many times a user does not need to use the entire contents of the large container, and so once exposed to air the remaining bulk contents quickly become unusable and are thus wasted.

One collapsible, reusable, evacuable storage container is shown in U.S. Pat. No. 5,480,030. This patent discloses a bag that is reclosable by means of a plastic zipper and that is evacuable via a one-way air valve assembly having a flexible diaphragm that seals against a valve seat. The valve assembly also has vanes positioned to prevent the bag material or bag contents from obstructing air holes or the diaphragm while air is being evacuated through the valve assembly.

Many commercially available evacuable storage bags are provided with an inverted U-shaped slider or clip mounted to the plastic zipper. This slider is capable of closing an open zipper, i.e., by camming the opposing zipper strips into engagement during slider travel in either direction, but cannot be used to open a closed zipper. The slider does not have means for opening the zipper because typically such means would leave a gap in the zipper, thereby preventing formation of a hermetic seal.

There is a continuing need for improvements in slider design for storage containers that need to be hermetically sealed.

BRIEF DESCRIPTION OF THE INVENTION

The present invention is directed to sliders of improved design for use in closing the zipper of a reclosable bag. More particularly, the invention is directed to molded sliders having an improved design for use in closing the zipper of an evacuable storage bag.

One aspect of the invention is a generally U-shaped slider comprising mutually opposing first and second sidewalls, a bridge connecting the first and second sidewalls, and a generally U-shaped stiffening rib projecting outward from the first and second sidewalls and the bridge, wherein portions of the first and second sidewalls on both sides of the stiffening rib have undulating external surfaces.

Another aspect of the invention is a molded piece comprising a generally U-shaped central volume of material of generally uniform dimension parallel to an axis, a first generally clip-shaped volume of material projecting from a first portion of the central volume in a first direction parallel to the axis, a second generally clip-shaped volume of material projecting from a second portion of the central volume in a second direction opposite to the first direction, the first generally clip-shaped volume of material having a first undulating external surface on one side and a second undulating external surface on another side, and the second generally clip-shaped volume of material having a first undulating external surface on one side and a second undulating external surface on another side, wherein the generally U-shaped central volume of material straddles a gap that continues in both directions to be straddled by the first and second generally clip-shaped volumes of material.

In addition, a reclosable bag is provided that incorporates one or more of various aspects of the invention. The reclosable bag comprises: a receptacle having an interior volume and a mouth, the receptacle comprising first and second panels; a flexible zipper comprising first and second zipper strips respectively joined to the first and second panels in the area of the mouth; and a generally U-shaped slider slidably mounted to the mouth and designed to cam the first and second zipper strips into engagement during slider travel in either direction along the zipper, the slider comprising mutually opposing first and second sidewalls, a bridge connecting the first and second sidewalls, a generally U-shaped stiffening rib projecting outward from the first and second sidewalls and the bridge; and one or more of the following features: (1) portions of the sidewalls on both sides of the stiffening rib have undulating external surfaces that facilitate manufacture by injection molding; (2) both sides of the stiffening rib are provided with respective curved depressions that are generally symmetrical relative to a central plane of the slide and that facilitate grasping by the storage bag user; and (3) retaining hooks at the distal ends of the sidewalls have angled surfaces that form an included angle of 30 to 45 degrees at an entry point into the gap between the sidewalls to facilitate automated slider insertion onto a zipper.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
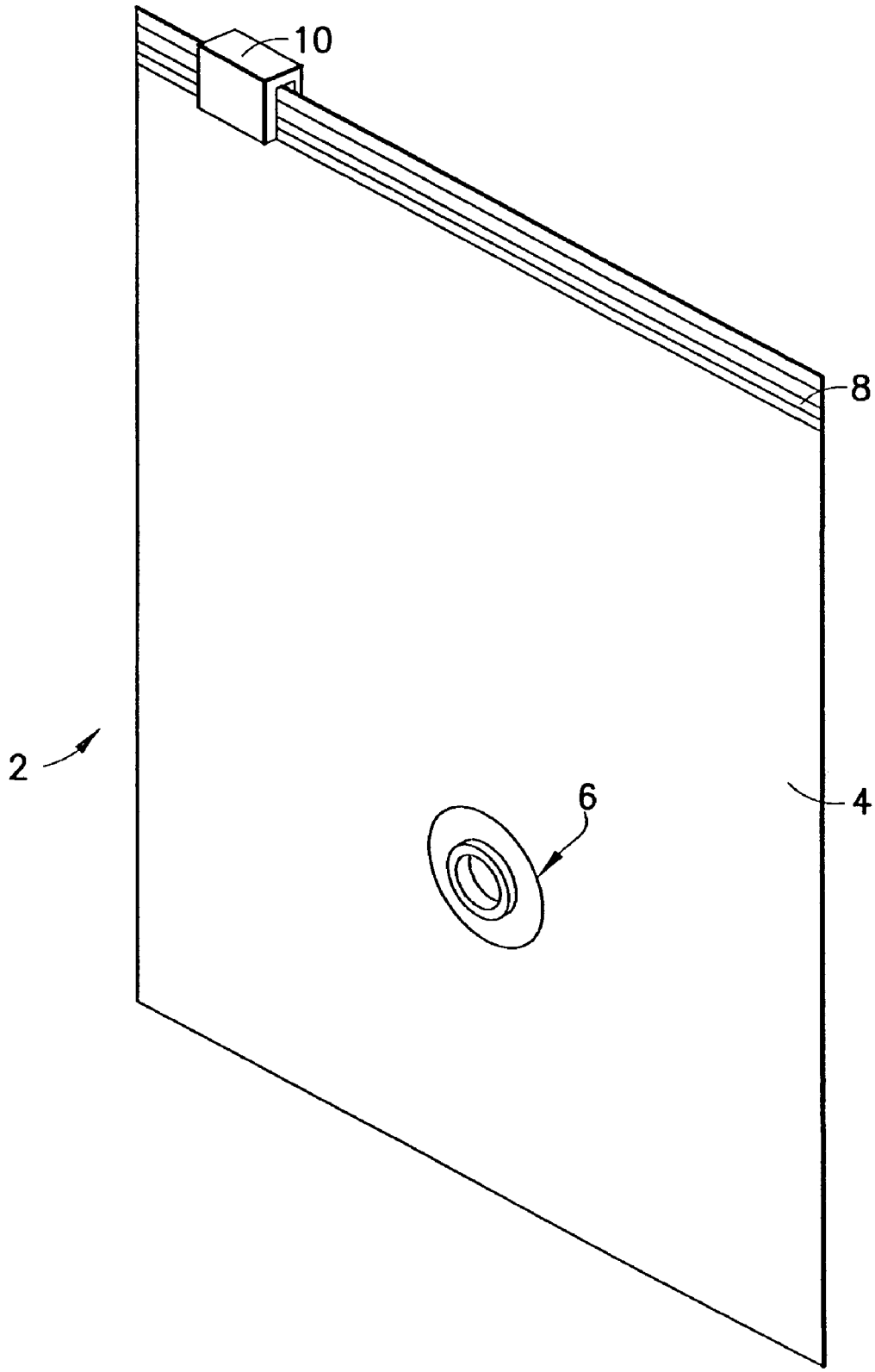
FIG. 1 PRIOR ART
FIG. 1 is a drawing showing an isometric view of one conventional type of collapsible, evacuable storage container having a zipper and a slider for closing the zipper.

FIG. 1 shows a conventional collapsible, evacuable storage container 2 comprising a bag 4, a valve assembly 6, and a zipper 8 comprising a pair of mutually interlockable extruded zipper strips that are joined to each other at opposing ends thereof. Although not shown in FIG. 1, the conventional valve assembly 6 also typically comprises a cap that can be snapped onto a portion of the valve assembly that is disposed on the exterior of the bag 4. The cap must be removed before the bag can be evacuated, and then is replaced after the bag has been evacuated. The cap is intended to seal the valve assembly to prevent air from entering the evacuated bag.

The bag 4 typically comprises front and rear walls or panels (made of thermoplastic film material) that are joined together at the bottom and two sides by conduction heat sealing to form a receptacle having an interior volume and a mouth in which the zipper 8 is installed. One wall of bag 4 has a hole (not shown in FIG. 1) in which to install the valve assembly 6. The bag may be constructed of a blended extrusion layer of polyethylene sandwiched between a nylon layer and a layer of polyethylene sheeting. However, the materials comprising the bag may be altered so as to prevent interaction with the bag contents. Alternatively, the bag 4 may be made from a web of film that is folded, the fold forming the bottom of the bag.

During use, one or more discrete articles or a bulk material (not shown) may be placed inside the bag 4 while the zipper 8 is open, i.e., while the closure profiles of the interlockable zipper strips are disengaged from each other. After the article or material to be stored has been placed inside the bag, the mouth of the bag 4 can be sealed by pressing the zipper strips together to cause their respective closure profiles to interlock with each other. Although the zipper closure profiles may have many different designs, the design must be one that ensures that an airtight seal can be formed at the mouth of the bag.

The zipper strips can be pressed together using a device 10 commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. The zipper is opened by pulling apart the zipper upper flanges, as explained in more detail below. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The zipper 8 is designed to form a hermetic seal at the mouth of the bag 4 when the zipper 8 closed. After the zipper has been closed, the interior volume of the bag can be evacuated by sucking air out via the one-way valve assembly 6. Air can be drawn out of bag 4 through valve assembly 6 using a conventional vacuum source, such as a household or industrial vacuum cleaner. The valve assembly 6 and the zipper 8 maintain the vacuum inside bag 4 after the vacuum source is removed.

The front and rear wall panels of the bag 4 are respectively sealed to the zipper strip by lengthwise conduction heat sealing in conventional manner. Alternatively, the interlockable zipper strips can be attached to the wall panels by adhesive or bonding strips or the zipper profiles can be extruded integrally with the bag material. The walls of the bag may be formed of various types of gas-impermeable thermoplastic material. The preferred gas-impermeable thermoplastics are some nylons, polyester, polyvinylidene chloride and ethylene vinyl acetate. The bag material may be either transparent or opaque.

In many reclosable bags, the zipper comprises a pair of mutually interlockable zipper strips, each zipper strip having a respective generally constant profile along the interlockable portion of the zipper. The ends of the zipper strips are joined together at the sides of the bag, e.g., by the application of heat and pressure.

The evacuable storage bag may be constructed from two panels of film joined together (e.g., by conduction heat sealing) along three sides of a rectangle. To maintain a vacuum inside the storage bag, the zipper in a closed state must provide a hermetic seal at the mouth (i.e., fourth side) of the bag. Many different types of zippers can be used. The present invention is not directed to any particular zipper construction. For the sake of illustration, however, a suitable zipper for use with the present invention will now be described with reference to FIG. 2.

Figure 2:
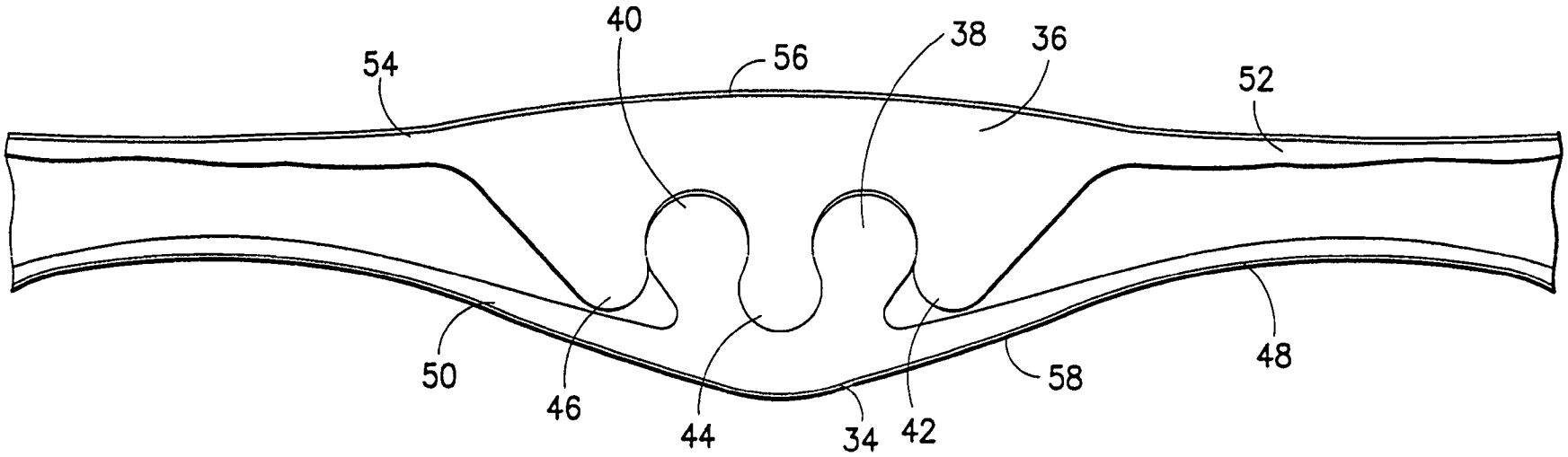
FIG. 2 is a drawing showing a cross-sectional view of a known zipper suitable for use with a bag of the type depicted in FIG. 1.

FIG. 2 shows a conventional zipper 8 that comprises a pair of mutually interlockable extruded zipper strips 34 and 36. The zipper strip 34 comprises a pair of projections 38 and 40 having ball-shaped closure profiles, an upper flange 48, and a lower flange 50. The zipper strip 36 comprises a trio of projections 42, 44 and 46 having ball-shaped closure profiles, a upper flange 52, and a lower flange 54. For each zipper strip, the portions exclusive of the projections will be referred to herein as a "base". The bag walls may be joined to the respective bases of the zipper strips by conduction heat sealing across their entire height or across only portions thereof. For example, the bag walls could be joined to the zipper lower flanges and to the upper flanges by means of conduction heat sealing, as shown in FIG. 2.

Still referring to FIG. 2, the projections 38 and 40 interlock with projections 42, 44 and 46 by fitting inside the respective spaces therebetween. The upper flanges 48 and 52 can be gripped by the user and pulled apart to open the closed zipper. The opened zipper can be reclosed by pressing the zipper strips together (e.g., using a slider) along the entire length of the zipper with sufficient force to cause the projections 38 and 40 to enter the respective spaces between the projections 42, 44 and 46. Typically, such a slider takes the form of a U-shaped clip that fits over the zipper with clearance for the upper flanges, while the legs of the clip cam the zipper profiles of the incoming zipper section into engagement when the slider is moved along the zipper in either direction. The opposing ends of the zipper strips 34 and 36 are typically fused together in the regions of the bag side seals, as previously described.

Figure 3:
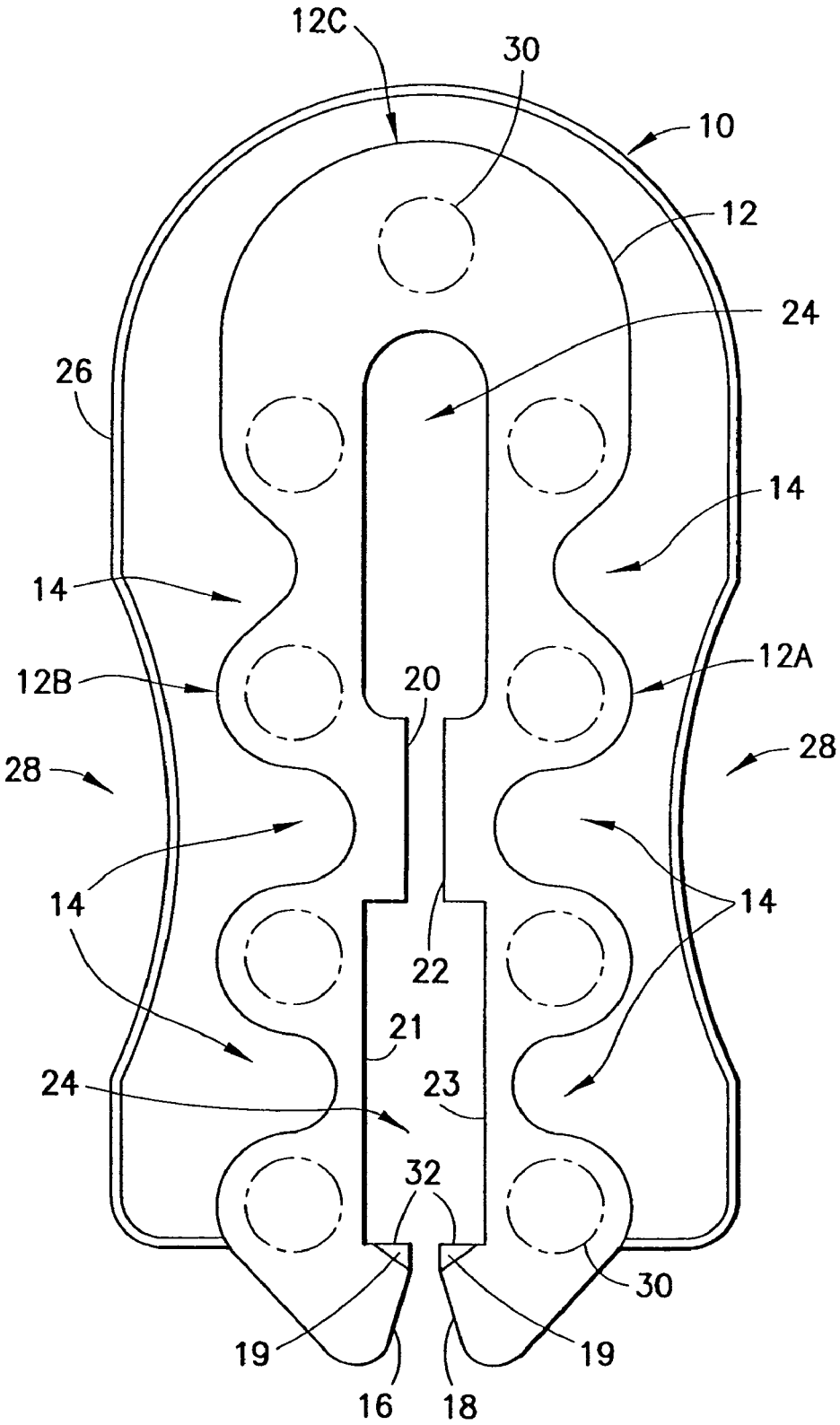
FIG. 3 is a drawing showing a front view of a slider in accordance with one embodiment of the invention.
Figure 4:
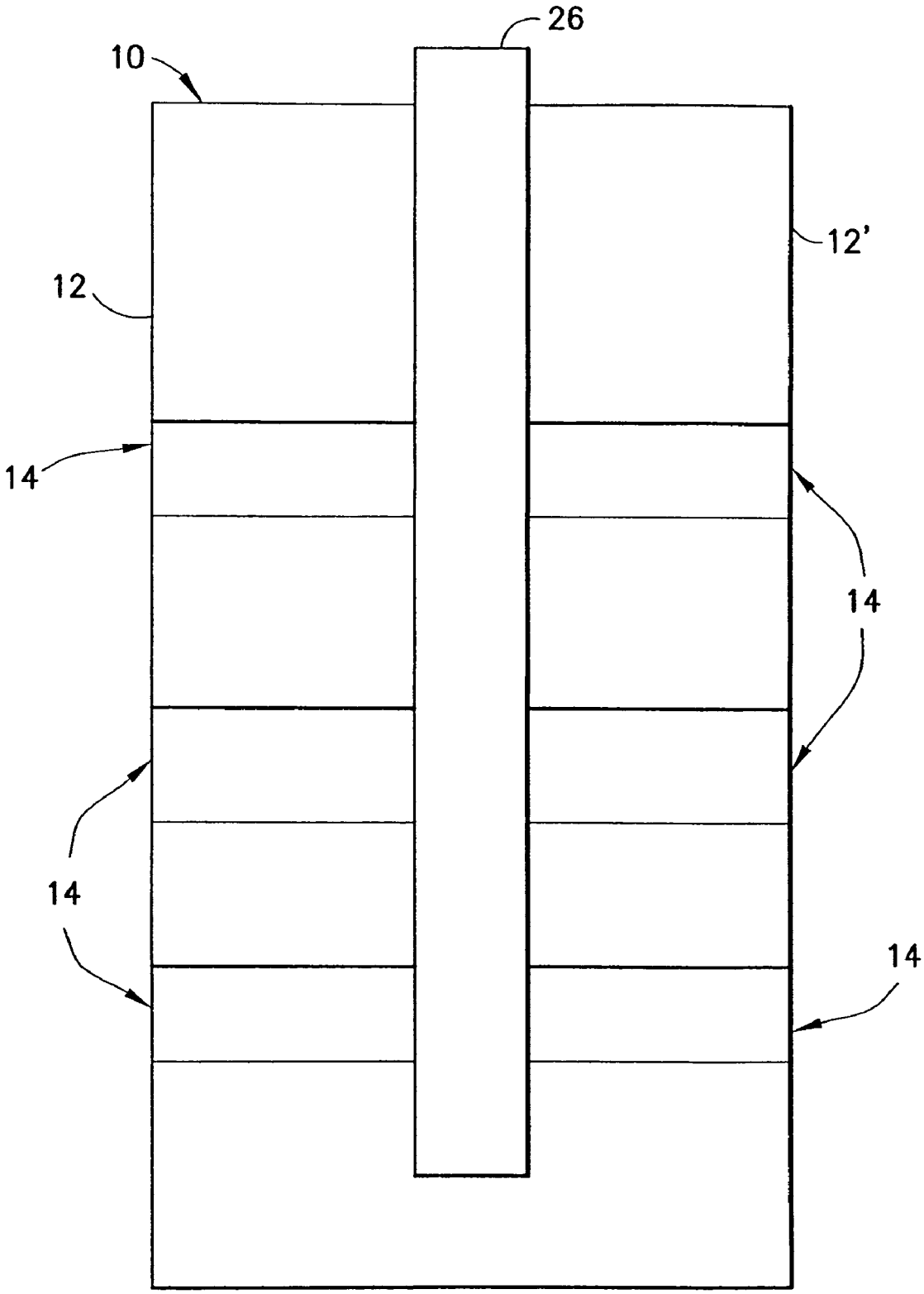
FIG. 4 is a drawing showing a side view of the slider depicted in FIG. 3.

A slider in accordance with one embodiment of the invention is shown in FIGS. 3 and 4, the former being a front view and the latter being a side view. As seen in FIG. 3, the slider 10 is generally U-shaped and comprises mutually opposing sidewalls 12A and 12B, a bridge 12C connecting the sidewalls 12A and 12B, and a generally U-shaped stiffening rib 26 projecting outward from the sidewalls 12A and 12B and the bridge 12C. The sidewalls 12A, 12B are separated by a gap 24 of varying width. The slider further comprises mirror-image angled projections 16 and 18 projecting from respective distal portions of sidewalls 12A and 12B. These angled projections will be referred to hereinafter as "retaining hooks". The hooks 16 and 18 have mutually opposing angled surfaces that form an included angle at an entry point into the gap 24. In the specific example depicted in FIG. 3, the included angle is about 30 degrees. However, this aspect of the invention encompasses a larger range of entry point angles of from 30 to 45 degrees. The reduced entry point angle reduces the amount of force needed to insert the slider onto the zipper and minimizes any potential damage to the slider profile.

Preferably the slider is made by injection molding, so that the stiffening rib is integral with the sidewalls and bridge. On one side of the stiffening rib 26, the sidewalls and bridge form a first generally clip-shaped structure 12 having undulating external surfaces, as best seen in FIG. 3. On the other side of the stiffening rib 26, the sidewalls and bridge form a second generally clip-shaped structure 12' that is the mirror image of structure 12. The undulations are formed by grooves or recesses 14 that have a curved concave profile, each pair of adjacent grooves defining a respective ridge therebetween, each ridge having a curved convex profile.

The slider gap 24 narrows in width at confronting generally parallel planar surfaces 20 and 22 of respective opposing plateaus. Below the plateaus, the gap is formed in part by confronting generally parallel planar surfaces 21 and 23, which form the base surfaces of respective grooves having generally rectilinear corners. The lower bounds of these grooves are formed by respective coplanar planar surfaces that form respective ledges 32 on retaining hooks 16 and 18, while the upper bounds are the lower sidefaces of the aforementioned plateaus. These mutually confronting rectilinear grooves define a lower chamber having a generally rectangular profile that is generally constant in the lengthwise direction. During slider insertion, the zipper and upper marginal portions of the bag panels (not shown in FIG. 3) enter the gap 24, with the zipper closure profiles residing in the lower chamber of the gap. The lower flanges of the zipper strips extend below the bottom of the slider, while the upper flanges of the zipper strips extend through the narrow section of the gap (between the opposing plateaus) and into the upper chamber of the gap 24. The corners 19 of the ledges 32 are beveled to facilitate the zipper passing through the gap 24 during slider travel.

The undulations in the sidewalls 12A and 12B facilitate manufacture by injection molding. Molten thermoplastic material is injected into the mold. After injection, the mold is chilled, e.g., by circulating cooling fluid. Then the mold is opened and the slider is ejected from the mold. In the case of a prior art process wherein the molded slider has sidewalls that have a generally uniform cross-sectional area, there is a tendency for sink holes to form on the interior surfaces of the slider during chilling. This is undesirable, especially on the confronting surfaces that define the lower chamber of the gap 24, in which the zipper resides. In contrast, the undulations in the sidewalls of the molded slider provide a change in cross-sectional area, i.e., reductions in thickness where grooves are formed. As a result, the sidewalls solidify more quickly during chilling, preserving the planarity and parallelism of the confronting surfaces 21 and 23 seen in FIG. 3.

The stiffening rib does not have an undulating surface, but has a pair of ergonomically designed curved depressions 28 on opposite sides of the stiffening ribs. The profile of each depression 28 is generally constant in a direction perpendicular to the page in FIG. 3. The curved depressions are generally symmetrical relative to a central plane of the slider and receptive to being grasped between a thumb and a digit of a human hand. The curvature is designed to generally match the shape of a finger or thumb tip, making it more comfortable for the bag user and also improving the bag user's grasp of the slider.

The sidefaces of the ridges of the undulating surfaces provide surfaces against which mold ejector (knockout) pins can operate. The dashed circles (one of which is designated by numeral 30) in FIG. 3 represent very shallow impressions or indentations made by the ejector pins when they push the slider out of the mold during manufacture. The greater the ejection force generated by the multiplicity of ejector pins, the smaller the draft angle can be inside the mold.

Reclosable bags of the type described herein can be manufactured on an automated production line. In accordance with one automated method of manufacture, two webs of film are paid off respective rolls and brought into overlying relationship. Downstream respective sets of pull rollers are provided for pulling the webs through the bag making machine. A continuous length of interlocked zipper strips is paid off a spool and fed between the advancing film webs. Typically the webs and the zipper are advanced intermittently, while certain operations are performed during the dwell times. At a first sealing station, marginal portions of opposing sections of each web are sealed to the backs of opposing section of the respective zipper strips by a first pair of horizontal heated sealing bars. At the same time, marginal portions of opposing sections of each web are heat sealed together to form a bottom seal. At an ultrasonic welding station, the zipper is stomped at package-length intervals, while a respective slider is inserted onto each unstomped section of zipper by a conventional slider insertion device. At a second sealing station, the cross seals are formed by conduction heat sealing. At a cutting station, the individual bags are severed from one another by cutting along a line that bisects the cross seal, thereby forming respective side seals on the separated bags. A person skilled in the art will appreciate that the bag could be formed from a single web that is folded and cross sealed, instead of from two webs that are bottom sealed and then cross sealed together. Also the zipper strips could be joined to the respective webs separately and then interlocked before ultrasonic welding of the zipper joints.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, co-extrusion (e.g., of zipper and bag), etc.

The invention claimed is:

1. A one-piece generally U-shaped slider comprising mutually opposing first and second sidewalls, a bridge connecting said first and second sidewalls, and a generally U-shaped stiffening rib projecting outward from and integrally formed with said first and second sidewalls and said bridge, wherein portions of said first and second sidewalls on both sides of said stiffening rib have undulating curved external surfaces, each undulating curved external surface comprising first and second grooves defining a ridge therebetween, each of said first and second grooves having a curved concave profile and said ridge having a curved convex profile, each of said first and second grooves terminating at said stiffening rib.

2. The slider as recited in claim 1, wherein said first and second sidewalls are separated by a gap of varying width, said gap comprising a portion formed by mutually opposing generally rectangular first and second grooves formed in part by mutually opposing and generally parallel internal surfaces of said first and second sidewalls.

3. The slider as recited in claim 2, further comprising a first angled projection projecting from a distal portion of said first sidewall and a second angled projection projecting from a distal portion of said second sidewall, mutually opposing angled surfaces of said first and second angled projections forming an included angle at an entry point into said gap.

4. The slider as recited in claim 3, wherein said included angle is 30 to 45 degrees.

5. The slider as recited in claim 3, wherein said first angled projection comprises a portion adjacent said gap that forms a first retaining ledge, and said second angled projection comprises a portion adjacent said gap that forms a second retaining ledge, said first and second retaining ledges having generally coplanar surfaces that bound said gap.

6. The slider as recited in claim 1, wherein said stiffening rib has a first curved depression on one side of said slider and a second curved depression on an opposite side of said slider, said first and second curved depressions being generally symmetrical relative to a central plane of said slider.

7. The slider as recited in claim 1, wherein each of said undulating curved external surfaces has a profile comprising a series of curves.

8. The slider as recited in claim 7, wherein said undulating curved external surfaces further comprise third and fourth undulating curved external surfaces disposed on another side of said slider, said third and fourth undulating curved external surfaces being separated by said stiffening rib and not connected to each other.

9. The slider as recited in claim 1, wherein said undulating curved external surfaces comprise first and second undulating curved external surfaces disposed on one side of said slider, said first and second undulating curved external surfaces being separated by said stiffening rib and not connected to each other.

10. The bag as recited in claim 9, wherein said undulating curved external surfaces further comprise third and fourth undulating curved external surfaces disposed on another side of said slider, said third and fourth undulating curved external surfaces being separated by said stiffening rib and not connected to each other.

11. The slider as recited in claim 1, wherein said first and second sidewalls and said bridge have respective surfaces that are portions of first and second end faces, said first grooves terminating at said first endface and said second grooves terminating at said second endface.

12. A reclosable bag comprising:

a receptacle having an interior volume and a mouth, said receptacle comprising first and second panels;

a flexible zipper comprising first and second zipper strips respectively joined to said first and second panels in the area of said mouth; and a generally U-shaped slider slidably mounted to said mouth and designed to cam said first and second zipper strips into engagement during slider travel in either direction along said zipper, said slider comprising mutually opposing first and second sidewalls, a bridge connecting said first and second sidewalls, and a generally U-shaped stiffening rib projecting outward from and integrally formed with said first and second sidewalls and said bridge, wherein portions of said first and second sidewalls on both sides of said stiffening rib have undulating curved external surfaces, each undulating curved external surface comprising first and second grooves defining a ridge therebetween, each of said first and second grooves having a curved concave profile and said ridge having a curved convex profile, each of said first and second grooves terminating at said stiffening rib.

13. The bag as recited in claim 12, wherein each of said undulating curved external surfaces has a profile comprising a series of curves.

14. The bag as recited in claim 12, wherein said undulating curved external surfaces comprise first and second undulating curved external surfaces disposed on one side of said slider, said first and second undulating curved external surfaces being separated by said stiffening rib and not connected to each other.

15. The bag as recited in claim 12, wherein said first and second sidewalls and said bridge have respective surfaces that are portions of first and second end faces, said first grooves terminating at said first endface and said second grooves terminating at said second endface.

* * * * *